US011077002B1

(12) United States Patent
Crump

(10) Patent No.: US 11,077,002 B1
(45) Date of Patent: Aug. 3, 2021

(54) POWER OPERATED LIFT CHAIR

(71) Applicant: David M. Crump, Owasso, OK (US)

(72) Inventor: David M. Crump, Owasso, OK (US)

( * ) Notice: Subject to any disclaimer, the term of this patent is extended or adjusted under 35 U.S.C. 154(b) by 321 days.

(21) Appl. No.: 16/229,275

(22) Filed: Dec. 21, 2018

Related U.S. Application Data

(60) Provisional application No. 62/608,888, filed on Dec. 21, 2017.

(51) Int. Cl.
*A61G 5/10* (2006.01)
*A61G 5/14* (2006.01)
*A61G 5/12* (2006.01)

(52) U.S. Cl.
CPC ..... *A61G 5/1059* (2013.01); *A61G 5/1045* (2016.11); *A61G 5/122* (2016.11); *A61G 5/125* (2016.11); *A61G 5/14* (2013.01)

(58) Field of Classification Search
CPC ..... A61G 5/1059; A61G 5/125; A61G 5/122; A61G 5/114; A61G 5/1045
See application file for complete search history.

(56) References Cited

U.S. PATENT DOCUMENTS 4,633,538 A * 1/1987 James ..... A61G 7/1019 187/200
4,704,749 A * 11/1987 Aubert ..... A61G 7/1019 280/250.1
4,862,997 A * 9/1989 Eberle ..... A61G 5/1059 182/148
6,430,761 B1 * 8/2002 Brandorff ..... A61G 7/053 5/81.1 R
7,273,255 B2 * 9/2007 Nylander ..... A61G 5/1059 297/330
7,428,759 B2 * 9/2008 Bain ..... A61G 7/1074 5/86.1
8,696,017 B2 * 4/2014 Wright ..... A61G 7/103 280/647
2008/0128213 A1 * 6/2008 Harris ..... B66B 9/08 187/201
2015/0035333 A1 * 2/2015 Schy ..... A61G 7/1019 297/331
2017/0304132 A1 * 10/2017 Bryant ..... A61G 5/104
2020/0113757 A1 * 4/2020 Abdullah ..... A61G 5/14

FOREIGN PATENT DOCUMENTS

CH 690417 A5 * 9/2000 ..... A61G 5/045

* cited by examiner

*Primary Examiner* — Tony H Winner
(74) *Attorney, Agent, or Firm* — Crowe & Dunlevy, P.C.; Shawn M. Dellegar

(57) ABSTRACT

The invention generally relates to a power operated lift chair. The power operated lift chair includes a chair assembly, a support assembly and a lifting assembly. The chair assembly includes a vertical back support, a back cushion attached to the vertical back support, a horizontal seat support and a seat cushion attached to the horizontal seat support. The support assembly includes a horizontal beam, a vertical guide post extending upward from the horizontal beam, a guide bracket connected to the chair assembly, at least one horizontal support member extending outward perpendicularly from the horizontal beam and a support platform. The lifting assembly includes a lifting rod positioned on the support platform and a locking collar connected to the lifting rod and the guide bracket. The lifting rod is configured to rotate to lift and lower the chair assembly.

19 Claims, 16 Drawing Sheets

POWER OPERATED LIFT CHAIR

CROSS-REFERENCE TO RELATED APPLICATIONS

This application claims the benefit of U.S. Provisional Patent Application Ser. No. 62/608,888 filed on Dec. 21, 2017 and incorporates said provisional application by reference into this document as if fully set out at this point.

BACKGROUND OF THE INVENTION

1. Field of the Invention

This invention relates generally to a power operated lift chair, and more particular to a power operated lift chair for assisting handicapped, invalids, or other individuals to move from one location to another.

2. Description of the Related Art

Various devices and methods have been used in the hospital and health care industry to assist health care professionals and care takers in moving disabled, elderly, invalids, or other individuals from one location to another. Some of the methods include physically lifting or carrying individuals from one location to another or pulling individuals using bed clothes to the side of a bed and then physically moving them down into a chair or onto another bed. Some devices that have been used previously are in the form of reclining lift chairs that move up and then forward to assist the individual sitting in the chair into a standing position. Many prior art devices are difficult to use and require extensive training prior to use and operation. The methods and devices available are often impracticable when the individual needing to be moved is located on the ground or in a position at which previous devices are not capable of being located.

In addition to the health care industry, individuals that are confined to wheelchairs often desire additional mobility and independence which is restricted by their confinement. For instance, these individuals might want to be able to reach items in higher shelves in their home or be able to move themselves from their chair to the bed or the bathroom. Prior wheelchairs are incapable of being raised and lowered from a ground position and to different heights to assist with the needs of these individuals.

There is therefore a need in the healthcare and care taker industry for a device that will better assist with the moving of individuals at various heights and from various locations. There is also a need for a device that will incorporate safe and reliable mechanisms to allow a chair to be set at different heights.

Before proceeding to a detailed description of the invention, however, it should be noted and remembered that the description of the invention which follows, together with the accompanying drawings, should not be construed as limiting the invention to the examples (or embodiments) shown and described. This is so because those skilled in the art to which the invention pertains will be able to devise other forms of this invention within the ambit of the appended claims.

SUMMARY OF THE INVENTION

In general, in a first aspect, the invention relates to a power operated lift chair. The chair has a chair assembly and a support assembly connected to and configured to provide support for the chair assembly. The support assembly has a generally open front portion configured to provide access to the chair assembly. The chair also has a lift assembly connected to the chair assembly and the support assembly. The lift assembly is configured to provide linear, vertical movement of the chair assembly between a lower position and an upper position.

The chair assembly can include a vertical back support, a back cushion attached to the vertical back support, a horizontal seat support, and a chair cushion removably and swivelably attached to the horizontal seat support. The chair assembly may be positioned adjacent to the ground or floor in the lower position.

The support assembly can include a generally horizontal crossbeam intermediate of horizontal support members extending generally perpendicular from the horizontal crossbeam. The support assembly can also include a support platform, which may extend from the horizontal crossbeam generally in an opposite direction from the horizontal support members.

The lifting assembly can include a generally vertical guide post connected to the horizontal crossbeam, a guide bracket connected to the vertical guide post and connected to the chair assembly, a lifting rod attached to the support assembly and extending generally parallel to the vertical guide post, and a locking collar configured to be connected to the lifting rod and the guide bracket. The lifting rod may be a worm gear, a screw shaft, a drive screw or other means configured to provide linear, vertical movement of the chair assembly between the lower position and the upper position. A motor can be connected to the lifting rod. In addition, a movement controller may be in communication with the motor and configured to control movement of the chair assembly between the lower position and the upper position.

The chair can also include a plurality of wheels configured to move the power operated lift chair along the ground or floor. Moreover, a pair of arms may be pivotally or otherwise attached to the chair assembly.

In general, in a second aspect, the invention relates to a power operated lift chair. Like the first aspect, the chair includes a chair assembly and a support assembly connected to and configured to provide support for the chair assembly. The support assembly has a generally open front portion configured to provide access to the chair assembly. The chair also includes a lift assembly connected to the chair assembly and the support assembly. In this aspect, the lifting assembly includes a generally vertical guide post connected to the support assembly and a guide bracket connected to the vertical guide post and connected to the chair assembly. The lifting assembly also includes a lifting rod attached to the support assembly and extending generally parallel to the vertical guide post and a locking collar configured to be connected to the lifting rod and the guide bracket. In this aspect, the lift assembly is configured to move the chair assembly between an upper position and a lower position, with the chair assembly positioned adjacent to a ground or floor in the lower position.

The chair assembly can include a vertical back support, a back cushion attached to the vertical back support, a horizontal seat support, and a chair cushion removably and swivelably attached to the horizontal seat support.

The support assembly can include a generally horizontal crossbeam intermediate of horizontal support members extending generally perpendicular from the horizontal crossbeam. The support assembly can also include a support platform, which may extend from the horizontal crossbeam generally in an opposite direction from the horizontal support members.

The lifting rod may be a worm gear, a screw shaft, a drive screw or other means configured to provide linear, vertical movement of the chair assembly between the lower position and the upper position. A motor can be connected to the lifting rod. In addition, a movement controller may be in communication with the motor and configured to control movement of the chair assembly between the lower position and the upper position.

The chair can also include a plurality of wheels configured to move the power operated lift chair along the ground or floor. Moreover, a pair of arms may be pivotally or otherwise attached to the chair assembly.

The foregoing has outlined in broad terms some of the more important features of the invention disclosed herein so that the detailed description that follows may be more clearly understood, and so that the contribution of the instant inventors to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Finally, it should be understood that the phraseology and terminology employed herein are for the purpose of description and should not be regarded as limiting, unless the specification specifically so limits the invention.

BRIEF DESCRIPTION OF THE DRAWINGS

These and further aspects of the invention are described in detail in the following examples and accompanying drawings.

DETAILED DESCRIPTION OF THE INVENTION

Figure 1:
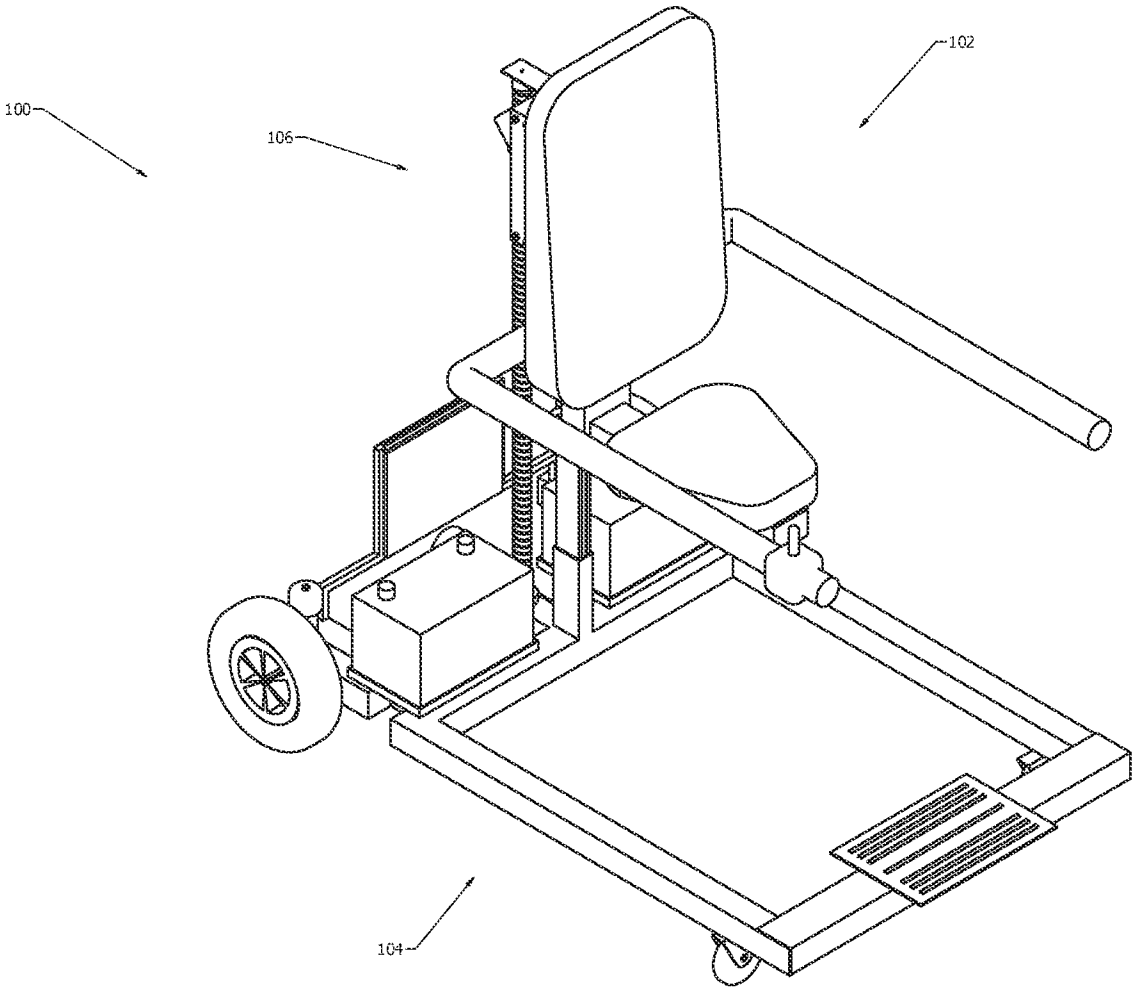
FIG. 1 is a perspective view of an example of a power operated lift chair having a chair assembly in an upper position in accordance with an illustrative embodiment of the invention disclosed herein.

While this invention is susceptible of embodiment in many different forms, there is shown in the drawings, and will herein be described hereinafter in detail, some specific embodiments of the instant invention. It should be understood, however, that the present disclosure is to be considered an exemplification of the principles of the invention and is not intended to limit the invention to the specific embodiments or algorithms so described.

Referring now to the figures of the drawings, wherein like numerals of reference designate like elements throughout the several views, a power operated lift chair 100 generally includes a chair assembly 102, a support assembly 104 and a lifting assembly 106.

As illustrated, the chair assembly 102 has a vertical back support 108 connected to a chair back 110. A horizontal seat support 112 with a swivelable seat cushion 114 removably connected to the horizontal seat support 112. The seat cushion 114 may be contoured to provide increased stability, comfort and safety for a patient/user. The chair back 110 may also be contoured to similarly provide stability, comfort and support. Additionally, the chair back 110 may be reclined in various positions using a hinge and lever mechanism or other reclining means known in the art. The use of various reclining positions provides the patient pressure relief.

The chair assembly 102 may also include a pair of arms 118 and/or a seat belt 120. The arms 118 can be pivotally attached to the chair assembly 102 allowing the arms 118 to be raised or lowered. In the lowered position, the arms 118 can be fixed into position using a pin, depressible detents or another known locking mechanism (not shown). The chair assembly 102 may also include various controls to assist a user in operation of the power operated lift chair 100. These controls could include a control joystick 122 for moving the chair forward and backward, upward and downward, and/or for alerting a third party of a need for assistance, such as a life support button. Although the control joystick 122 is depicted as being connected to the pair of arms 118, it will be understood that one or more controls could be connected to other parts of the chair assembly 102 (e.g., a foot controller attached to the support assembly 104), could be loose/disconnected from the chair assembly 102 so that the user could locate the control joystick 122 in a position desired by the user, or could be wireless. The control joystick 122 is electronically connected to a suitable computer type processor 124 for controlling motion of the chair 100.

The support assembly 104 has a vertical guide post 130 with a guide bracket 132 surrounding the vertical guide post 130. The guide bracket 132 is configured to slide up and down the vertical guide post 130 along bushings, bearings, wheels or other suitable means to help the guide bracket 132 slide up and down along the vertical guide post 130. As exemplified in the figures, the support assembly 104 can be generally U-shaped having a front, open end to allow the patient to access to chair 100 from the floor. The vertical guide post 130 may have a lower end connected to and centered on a horizontal crossbeam 136. The support assembly 104 also includes two horizontal support members 138 connected to and extending out perpendicularly from the horizontal crossbeam 136. A support platform 140 can be attached to and extend from the horizontal crossbeam 136 for supporting the processor 124 and any other components of the chair 100.

The support assembly 104 includes front wheels 142 swivelably connected to a front of the support assembly 104, such as to the horizontal support members 138. Rear wheels 144 are connected to a rear of the support assembly 104, such as to the horizontal crossbeam 136. The rear wheels 144 can be powered to aid in movement of the chair 100. It will be understood that the purpose of the front wheels 142 and the rear wheels 144 is to assist in moving the power operated lift chair 100, and as such, may alternatively be located anywhere on the horizontal support members 138, the horizontal crossbeam 136, or elsewhere on the support assembly 104. It will further be understood that more wheels may be used than shown or no wheels may be used if the power operated lift chair 100 is to be used as a stationary device.

The width of the chair 100 across the rear wheels 144 and the horizontal crossbeam 136 may be less than the width of a standard door frame, such as 24 to 30 inches wide. Alternatively, the distance between the two horizontal support members 138 can be adjusted, such as by using a telescoping horizontal crossbeam 136 or other known means.

In addition, the front of the support assembly 104 can also include a footrest horizontal crossbeam 146 that is parallel to the horizontal crossbeam 136 and removably connected to the two horizontal support members 138 with screws, pins or other suitable fastening means.

Figure 2:
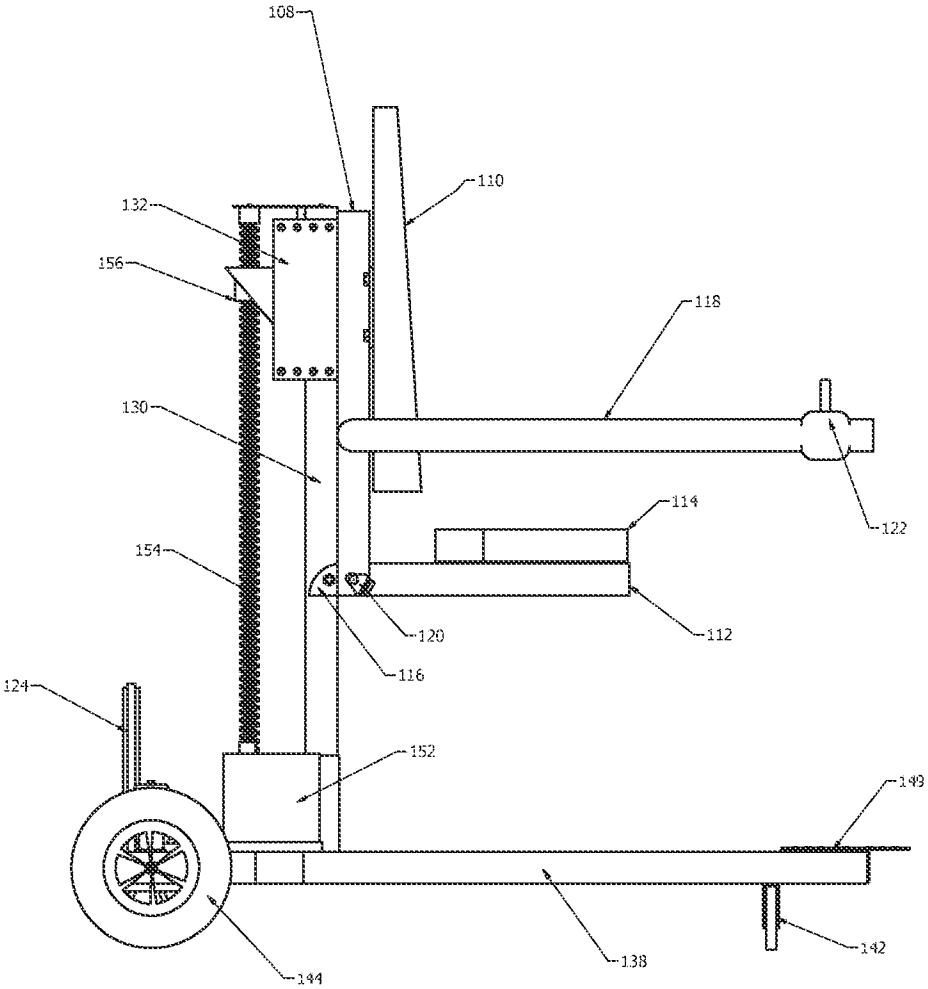
FIG. 2 is side elevation view of the power operated lift chair shown in FIG. 1.
Figure 3:
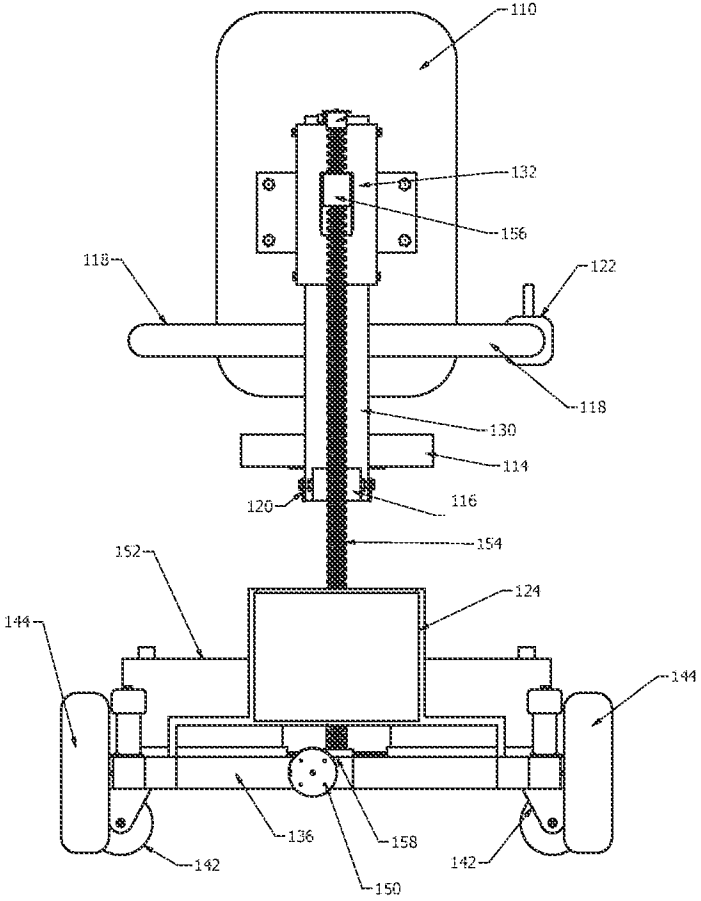
FIG. 3 is rear elevation view of the power operated lift chair shown in FIG. 1.
Figure 4:
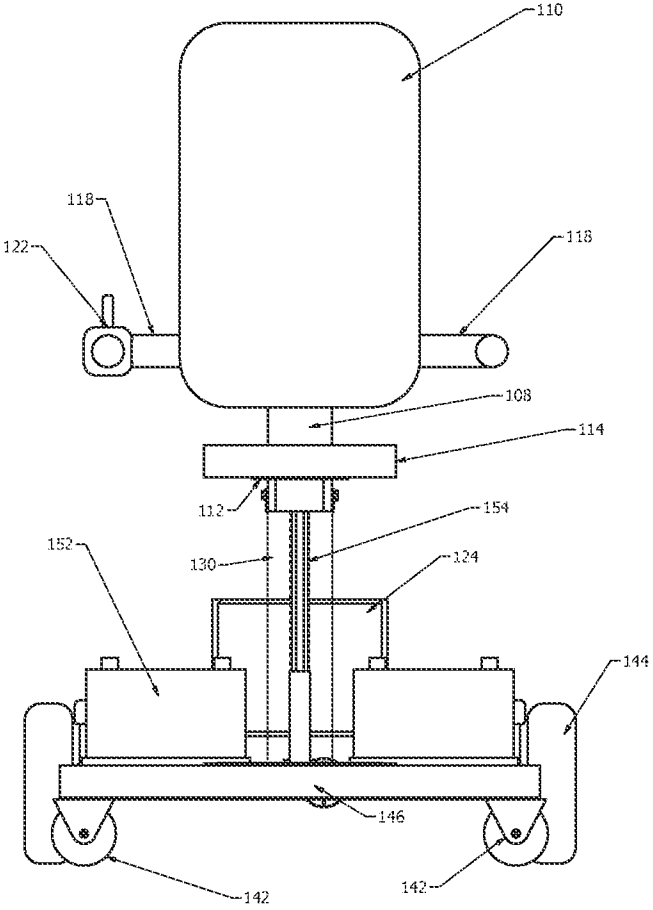
FIG. 4 is a front elevation view of the power operated lift chair shown in FIG. 1.
Figure 5:
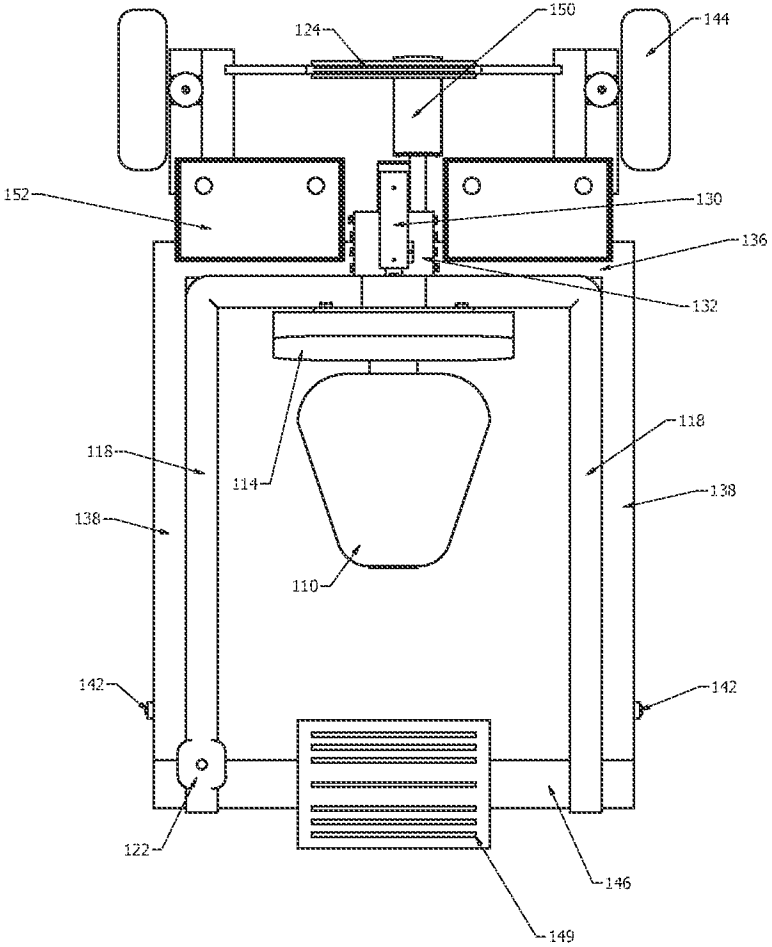
FIG. 5 is a top elevation view of the power operated lift chair shown in FIG. 1.
Figure 6:
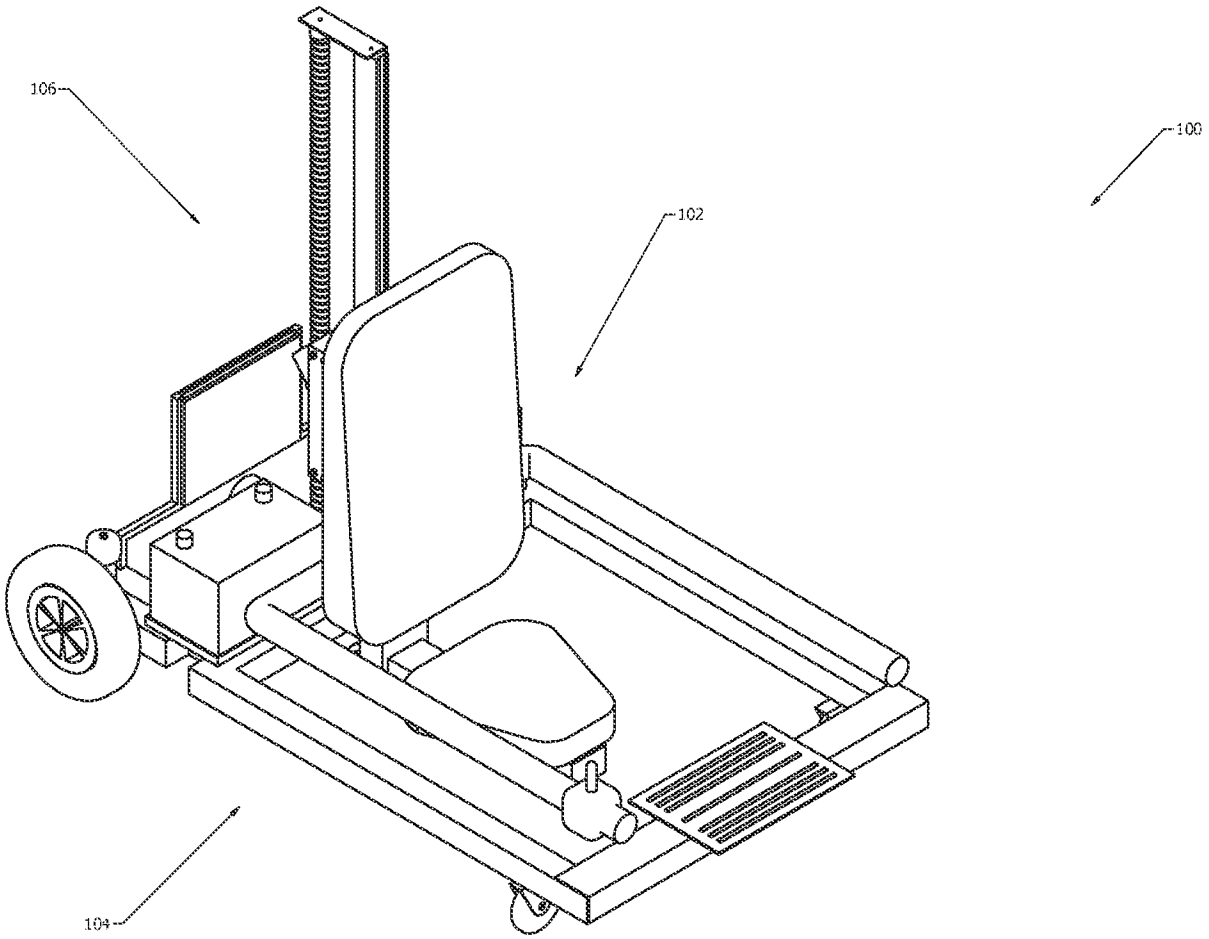
FIG. 6 is a perspective view of the power operated lift chair shown in FIG. 1 having the chair assembly in a lower position.
Figure 7:
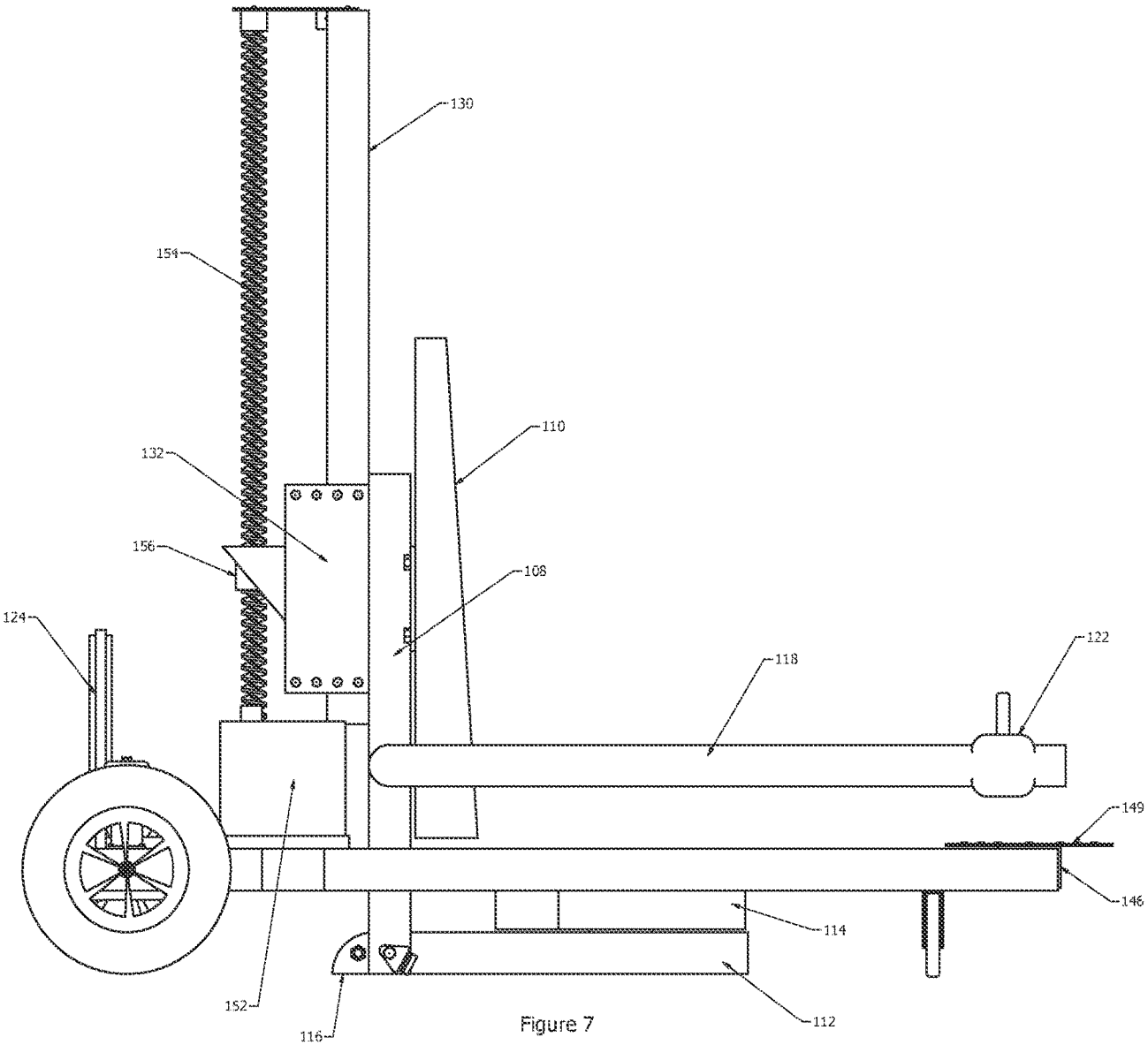
FIG. 7 is side elevation view of the power operated lift chair shown in FIG. 6.
Figure 8:
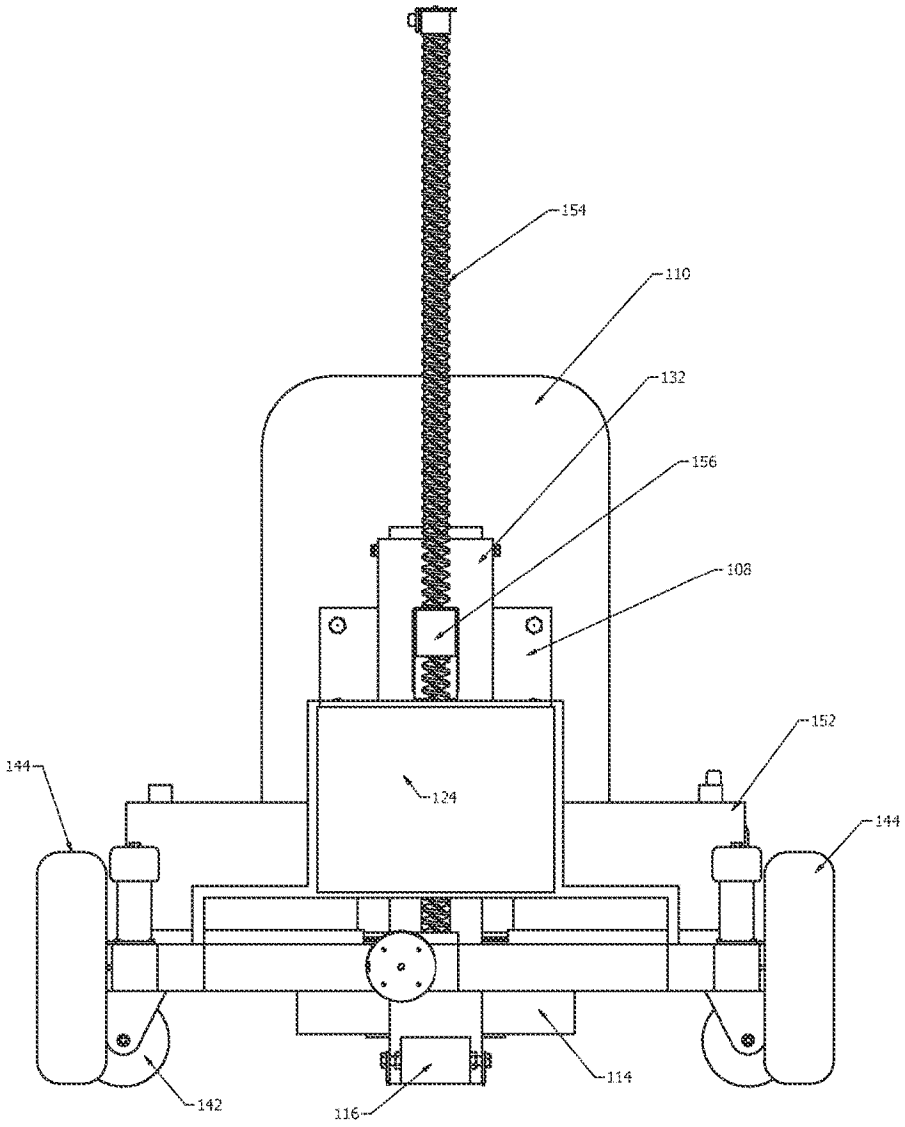
FIG. 8 is rear elevation view of the power operated lift chair shown in FIG. 6.
Figure 9:
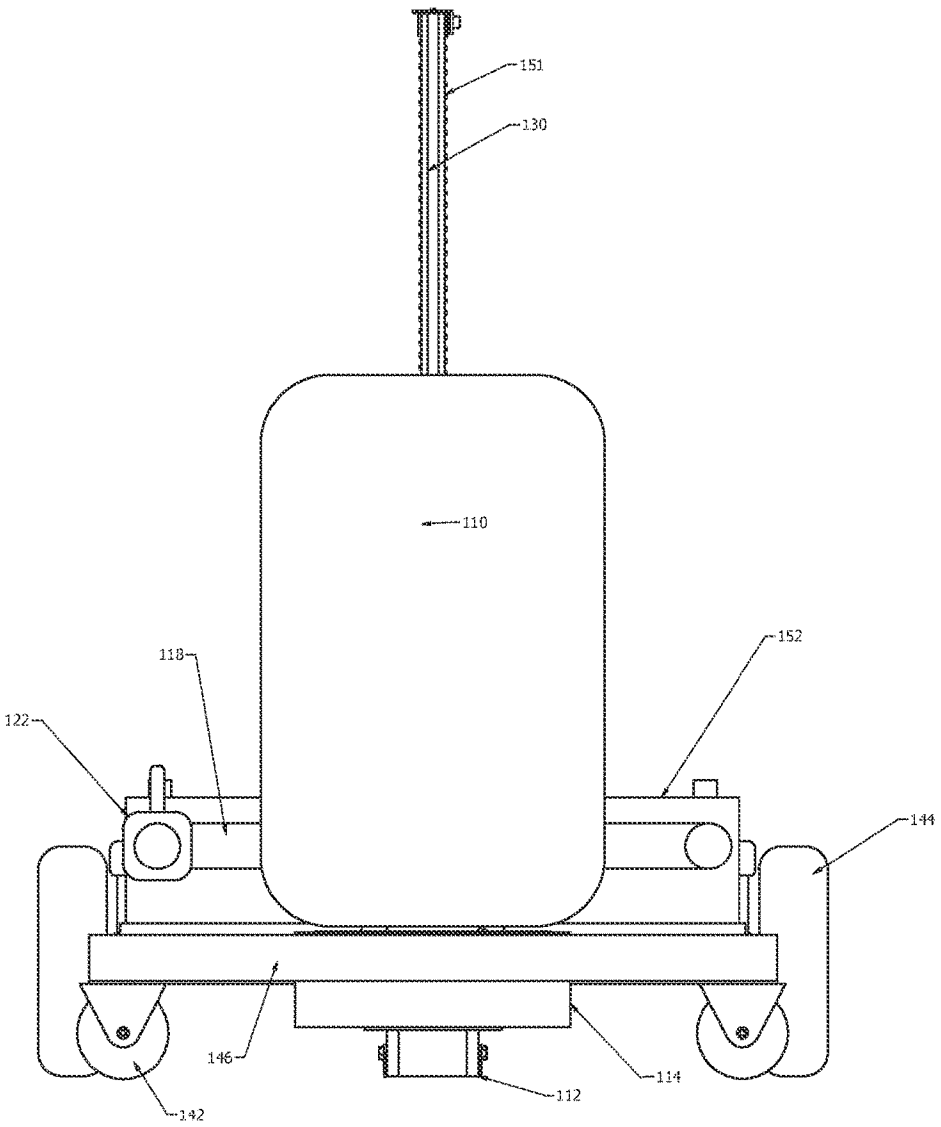
FIG. 9 is a front elevation view of the power operated lift chair shown in FIG. 6.
Figure 10:
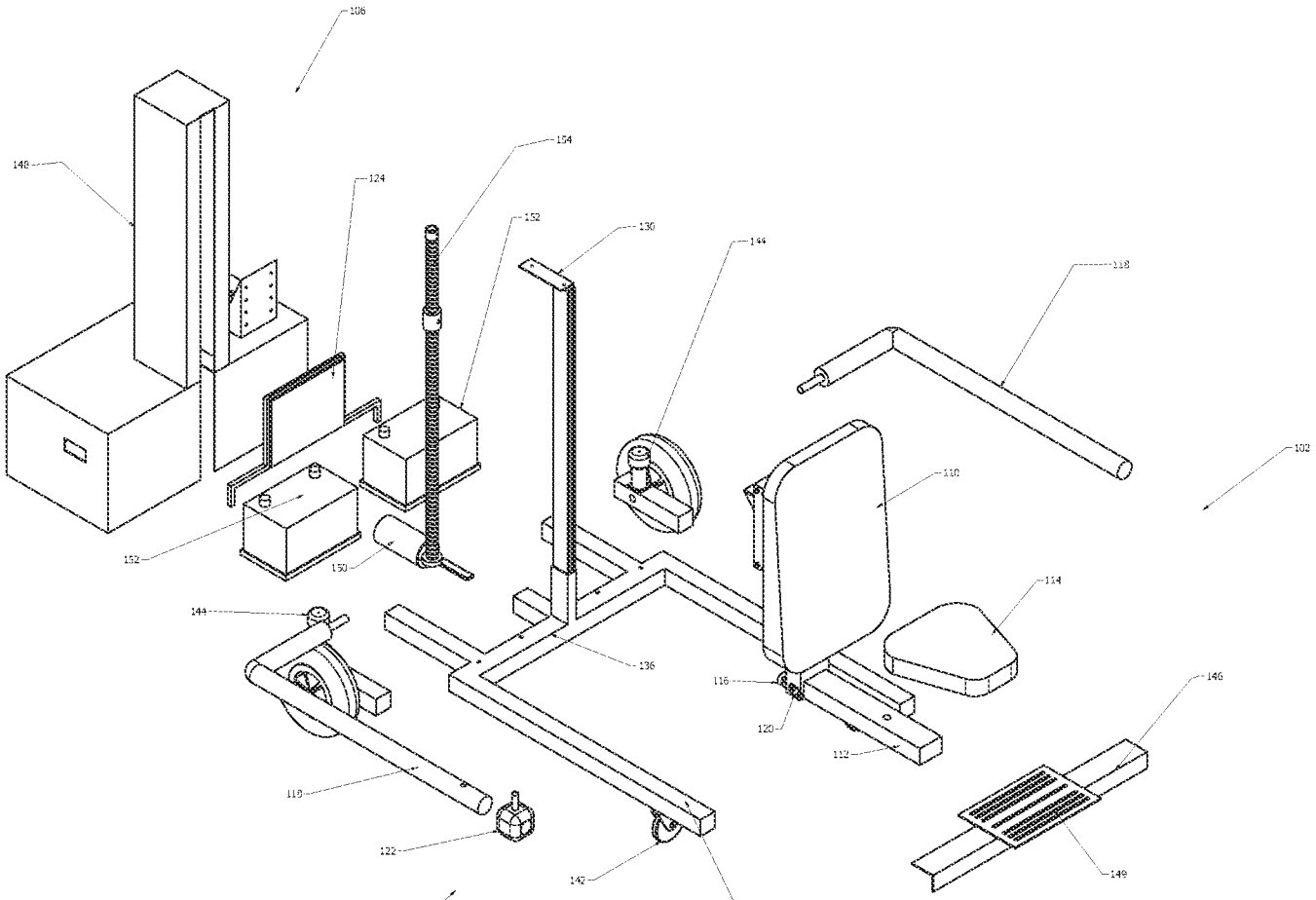
FIG. 10 is an exploded, perspective view of an example of a power operated lift chair in accordance with an illustrative embodiment of the invention disclosed herein.
Figure 11:
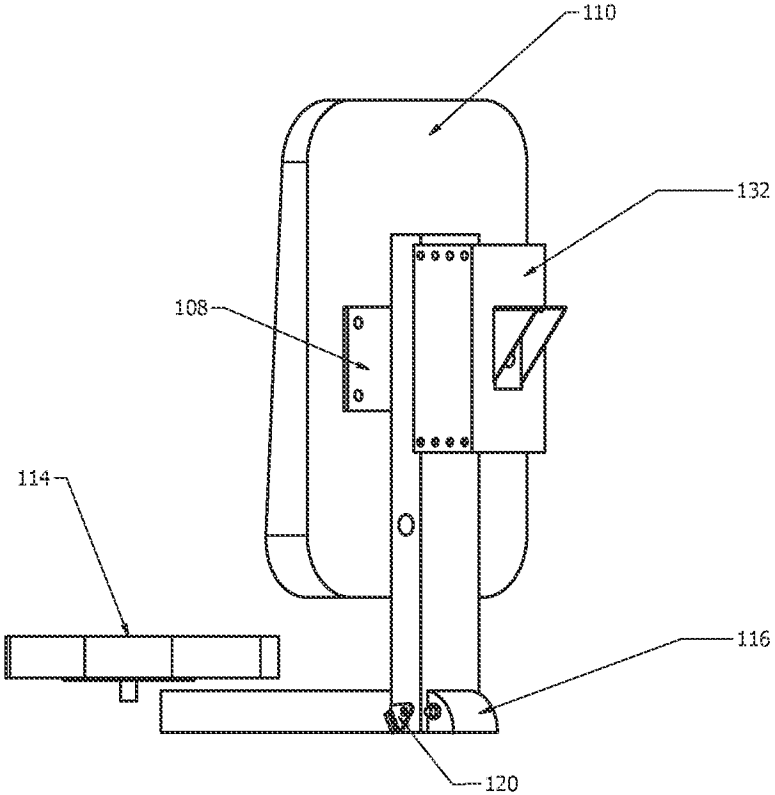
FIG. 11 is a rear perspective view of a portion of the chair assembly shown in FIG. 10.
Figure 12:
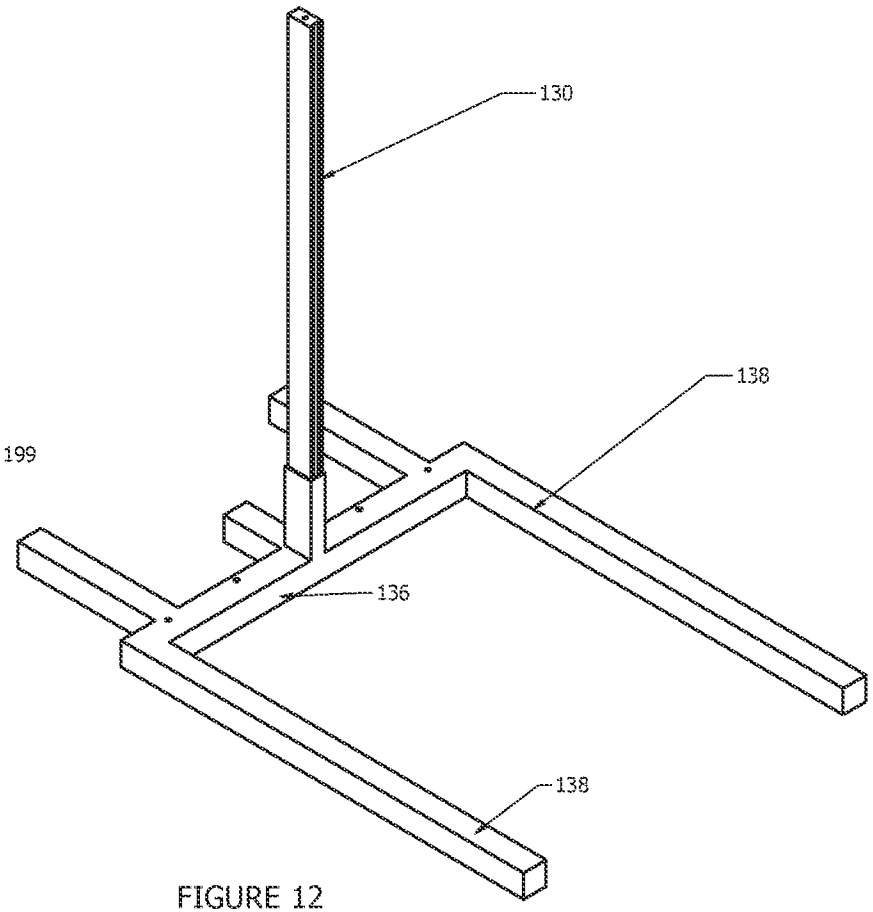
FIG. 12 is a perspective view of a portion of a support assembly shown in FIG. 10.
Figure 13:
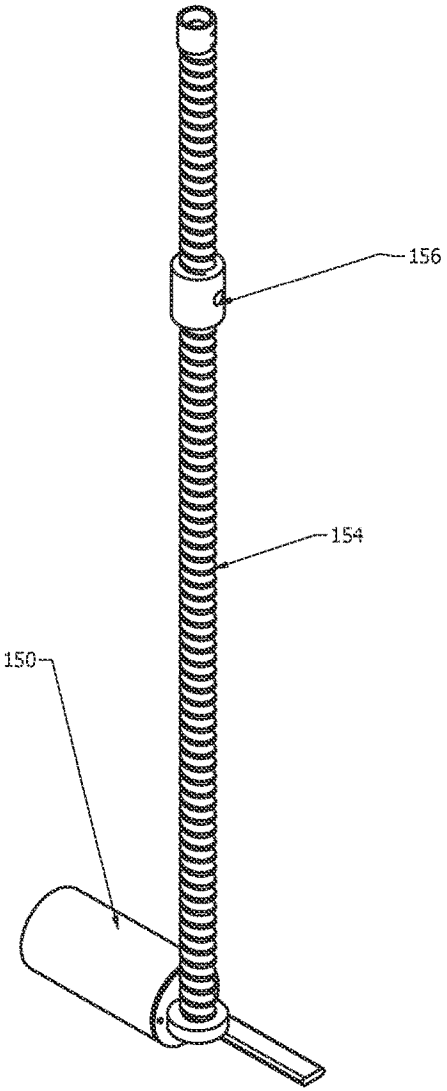
FIG. 13 is a perspective view of a portion of a lifting assembly shown in FIG. 10.
Figure 14:
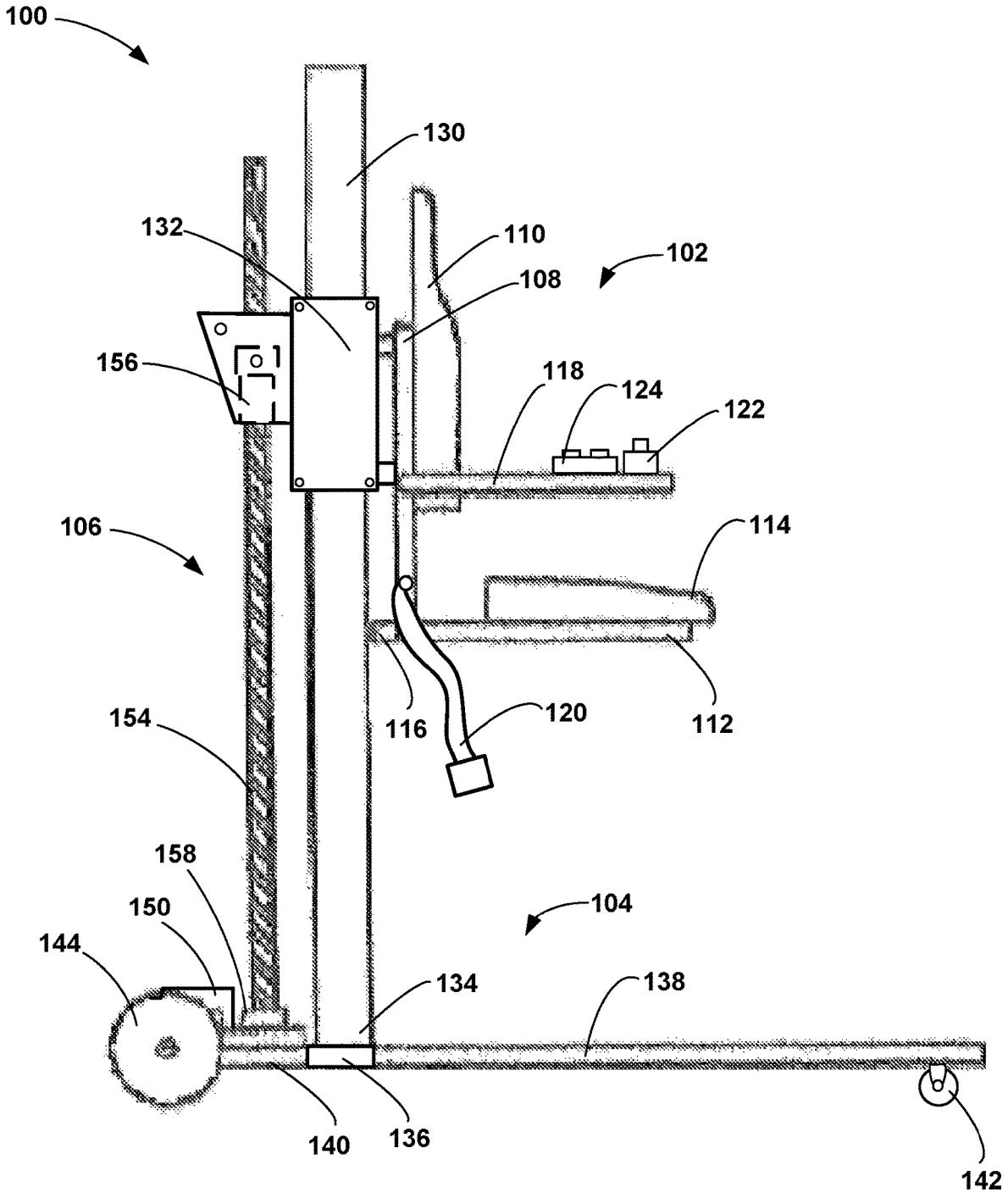
FIG. 14 is a side elevation view of another example of a power operated lift chair having a chair assembly in an upper position in accordance with an illustrative embodiment of the invention disclosed herein.
Figure 15:
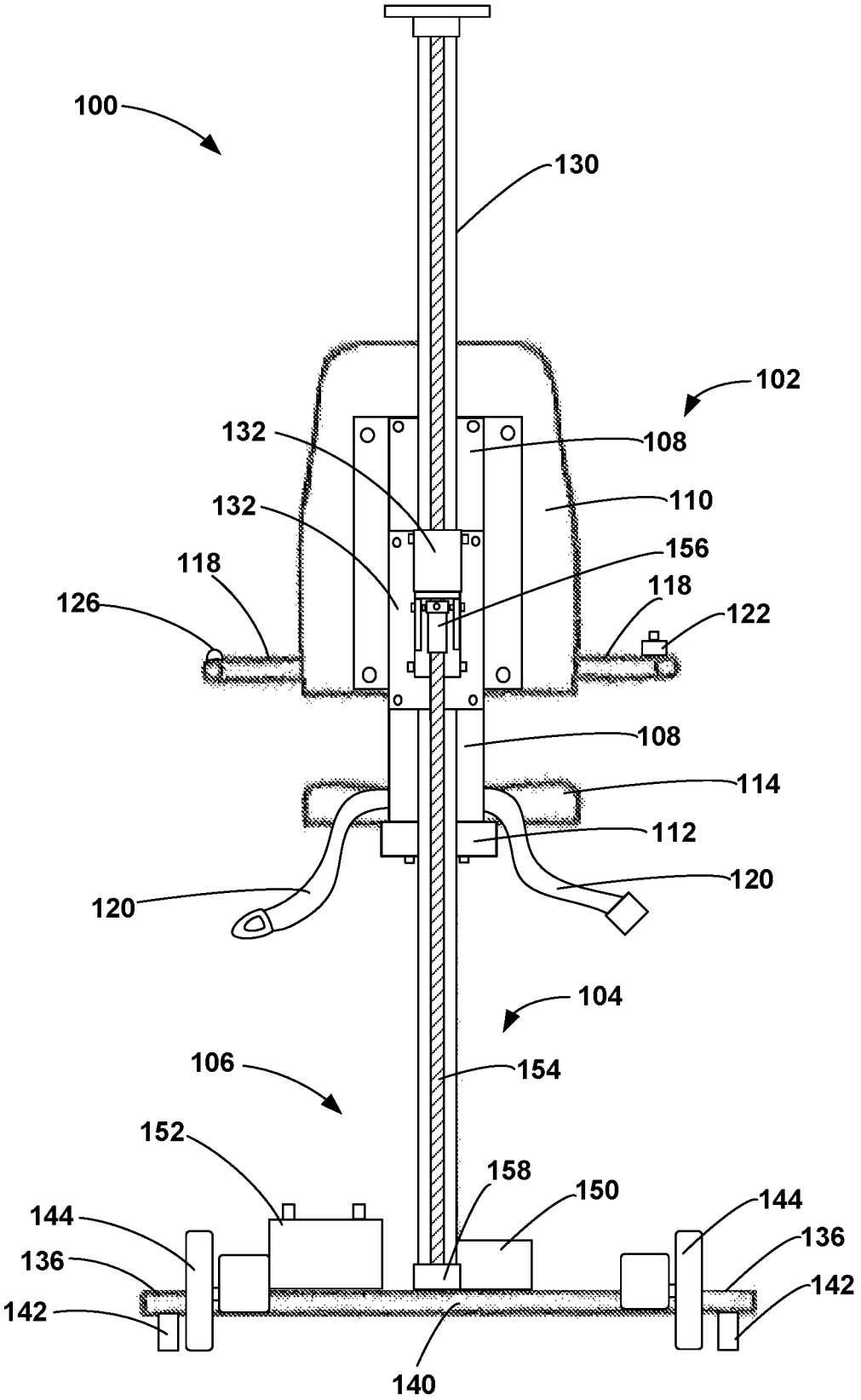
FIG. 15 is rear elevation view of the power operated lift chair shown in FIG. 14.
Figure 16:
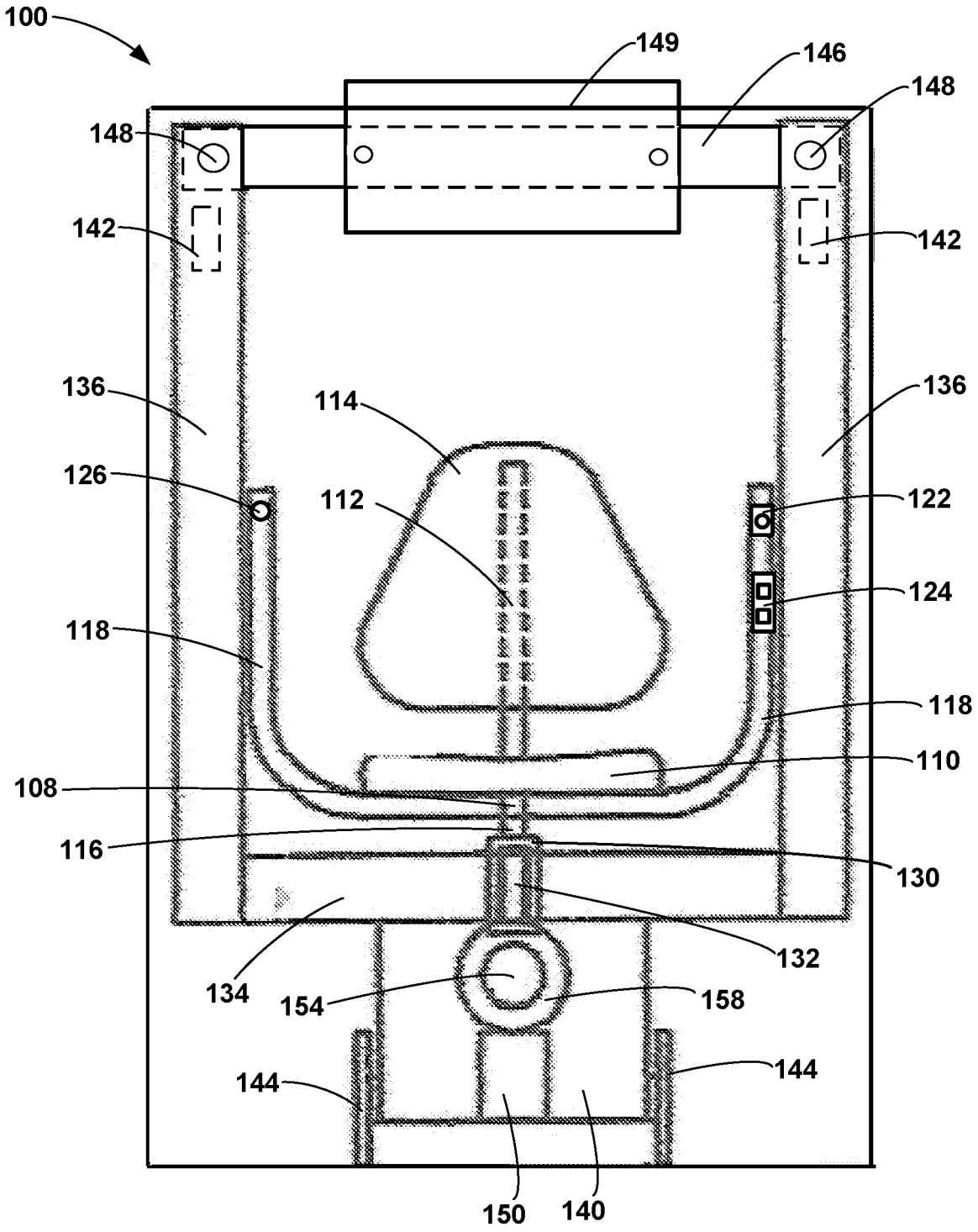
FIG. 16 is top elevation view of the power operated lift chair shown in FIG. 14.

The lifting assembly 106 preferably includes a motor 150, a battery or electrical supply 152, a lifting rod 154, and a locking collar 156. A lifting shoe 158 can be attached to the horizontal crossbeam 136 and configured to hold the lifting rod 154 in place. Alternatively, the lifting assembly 106 may not include the motor 150 but be operable through a hand crank or other means to lift and lower the chair assembly 102. The locking collar 156 of the lifting assembly 106 is connected to the guide bracket 132 and to the lifting rod 154 using a suitable fastening means. The lifting assembly 106 can be contained within a safety housing 148. As illustrated, the lifting rod 154 is a generally vertical worm gear, screw shaft, drive screw or the like configured to provide linear, vertical movement of the chair assembly 102 between a lowered position (FIGS. 1-5) and a raised position (FIGS. 6-9).

The chair assembly 102, the support assembly 104 and the lifting assembly 106 are connected such that the guide bracket 132 of the support assembly 104 is connected to the vertical back support 108 of the chair assembly 102. It will be also understood that the guide bracket 134 could be alternatively secured to the chair back 110 instead of the vertical back support 108 or could be secured to both. Moreover, the vertical back support 108 of the chair assembly 102 can be pivotally attached to the support assembly 104 allowing the chair assembly 102 to swivel to the left or the right to provide easy access for the user.

During usage of the power operated lift chair 100, the patient user may operate the control joystick 122 to move the power operated lift chair 100 backwards and forwards or left and right. The user may also operate the control 122 to move the power operated lift chair 100 up and down. In this case, the control 122 operates the motor 150 to turn the lifting rod 154. The lifting rod 154 is configured to have threads that act like a screw to rotate the lifting rod 154 and move the entire chair assembly 102 up or down the lifting assembly 106 along the guide bracket 132 when it is locked in place with the locking collar 156. A seat guide 116 can be positioned between the vertical guide post 130 and the horizontal seat support 112 to provide support and reduce friction when the chair assembly 102 is moved up and down the vertical guide post 130.

The position of the guide bracket 132 and the chair assembly 102 allows the power operated lift chair 100 to be positioned at or near the ground or floor as depicted in FIGS. 1-5. This allows the patient to move from a ground position onto the chair 100 with ease or allows medical staff (e.g., nurse or other caregiver) to move the patient easily into the chair 100. The lift chair's 100 ability to go from ground level to fully upright can also help to protect medical staff from back or other injury, which can lead to missed days at work and to high costs for employers.

The power operated lift chair 100 may also be operated to allow the chair assembly 102 to be lifted to the top of the lifting rod 156 to allow the patient in the chair assembly 102 to access desired heights, such as kitchen cabinets of closets and the like. The shape of the chair back 110 and the seat cushion 114 and the use of the seat belt 120 provide stability and safe to prevent the individual from falling out of the chair.

The power operated lift chair disclosed herein provides benefits to multiple populations, such as follows:

SNF (skilled nursing facility): These facilities provide therapy disciplines such as PT/OT. The power operated lift chair disclosed herein could be used as a tool to promote gait training therapy, neuromuscular reeducation, therapeutic exercises and activities, and self-care management training for patients following a THA (total hip arthroplasty), TKR (total knee replacement), etc., for example.

LTC (long-term care facility): Facility houses a community of residents at risk for or currently experiencing frequent falls along with the healthcare providers caring for these residents. The inventive lift chair is safer than mechanical lifts currently utilized due to improper sleeve fitting, lack of appropriate lift training, etc., prior to use.

Hospital setting: Acute care setting provides multi-disciplinary care for individuals with extensive health issues that include cognitive deficits, mobility, ambulation, and other issues that require the assistance of a lift device for safety and health-related reasons. The healthcare providers in these settings would benefit as well related to decreasing workplace incidents. Expected response time of incident to completion of assessment/treatment provided would most certainly decrease which promotes patient care satisfaction.

Public setting: Buildings/facilities that provide community resources and public services with diverse populations such as airports, shopping centers, etc., could effectively decrease the number of fall-related incidents that result in out-of-pocket expenses for companies due to accident claims, lawsuits, work-related incidents, etc.

Home-care setting: The power operated lift chair disclosed herein provides for longer independence within the home for our geriatric and disabled population. These individuals and/or their families wish to remain in the home but may be unable due to mobility issues (spouse falls, and caregiver has inability to help from the floor). The power operated lift chair could decrease visits from emergency services, such as the fire department, etc., which cuts back on taxpayer dollars and state funding.

An added benefit of the power operated lift chair 100 is the availability of the device in both manual and electrical form. Depending upon the expectation and need of the buyer(s), this lift chair 100 could be made affordable to a diverse population with the ability to purchase a less expensive model/version.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

It is to be understood that were the specification or claims refer to relative terms, such as "front," "rear," "lower," "upper," "horizontal," "vertical," "above," "below," "up," "down," "top," "bottom," "left," and "right" as well as derivatives thereof (e.g., "horizontally," "downwardly," "upwardly" etc.), such reference is used for the sake of clarity and not as terms of limitation, and should be construed to refer to the orientation as then described or as shown in the drawings under discussion. These relative terms are for convenience of description and do not require that the apparatus be constructed or the method to be operated in a particular orientation.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the instant disclosure may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

For purposes of the instant disclosure, the term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Still further, additional aspects of the instant invention may be found in one or more appendices attached hereto and/or filed herewith, the disclosures of which are incorporated herein by reference as if fully set out at this point.

Thus, the present invention is well adapted to carry out the objects and attain the ends and advantages mentioned above as well as those inherent therein. While the inventive concept has been described and illustrated herein by reference to certain illustrative embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A power operated lift chair, comprising:

a chair assembly;

a support assembly connected to and configured to provide support for the chair assembly; the support assembly having a generally open front portion configured to provide access to the chair assembly; and a lift assembly connected to the chair assembly and the support assembly; the lift assembly configured to provide linear, vertical movement of the chair assembly between a lower position and an upper position; wherein the lifting assembly further comprises:

a generally vertical guide post connected to the horizontal crossbeam;

a guide bracket connected to the vertical guide post and connected to the chair assembly;

a lifting rod attached to the support assembly and extending generally parallel to the vertical guide post; wherein said lifting rod comprises a worm gear, a screw shaft, a drive screw or other means configured to provide linear, vertical movement of the chair assembly between the lower position and the upper position; and a locking collar configured to be connected to the lifting rod and the guide bracket.

2. The chair of claim 1 wherein the chair assembly further comprises:

a vertical back support;

a back cushion attached to the vertical back support;

a horizontal seat support; and a chair cushion removably and swivelably attached to the horizontal seat support.

3. The chair of claim 1 wherein the chair assembly is positioned adjacent to a ground or floor in the lower position.

4. The chair of claim 1 wherein the support assembly further comprises a generally horizontal crossbeam intermediate of horizontal support members extending generally perpendicular from the horizontal crossbeam.

5. The chair of claim 1 wherein the support assembly further comprises a support platform.

6. The chair of claim 5 wherein said support platform extends from the horizontal crossbeam generally in an opposite direction from the horizontal support members.

7. The chair of claim 1 wherein said chair assembly further comprises a pair of arms.

8. The chair of claim 7 wherein the arms are pivotally attached to the chair assembly.

9. The chair of claim 1 further comprising a motor connecting to the lifting rod.

10. The chair of claim 9 further comprising a movement controller in communication with the motor and configured to control movement of the chair assembly between the lower position and the upper position.

11. The chair of claim 1 further comprising a plurality of wheels configured to move the power operated lift chair along a ground or floor.

12. A power operated lift chair, comprising:

a chair assembly;

a support assembly connected to and configured to provide support for the chair assembly; the support assembly having a generally open front portion configured to provide access to the chair assembly; and a lift assembly connected to the chair assembly and the support assembly; the lifting assembly further comprising:

a generally vertical guide post connected to the support assembly;

a guide bracket connected to the vertical guide post and connected to the chair assembly;

a lifting rod attached to the support assembly and extending generally parallel to the vertical guide post; and a locking collar configured to be connected to the lifting rod and the guide bracket;

wherein the lift assembly is configured to move the chair assembly between an upper position and a lower position; wherein the chair assembly is positioned adjacent to a ground or floor in the lower position.

13. The chair of claim 12 further comprising a plurality of wheels configured to move the power operated lift chair along the ground or floor.

14. The chair of claim 12 wherein said chair assembly further comprises a pair of arms pivotally attached to the chair assembly.

15. The chair of claim 12 wherein the chair assembly further comprises:

a vertical back support;

a back cushion attached to the vertical back support;

a horizontal seat support; and a chair cushion removably and swivelably attached to the horizontal seat support.

16. The chair of claim 12 wherein the support assembly further comprises a generally horizontal crossbeam intermediate of horizontal support members extending generally perpendicular from the horizontal crossbeam.

17. The chair of claim 12 wherein the lifting rod comprises a worm gear, a screw shaft, a drive screw or other means configured to provide linear, vertical movement of the chair assembly between the lower position and the upper position.

18. The chair of claim 17 further comprising a motor connecting to the lifting rod.

19. The chair of claim 18 further comprising a movement controller in communication with the motor and configured to control movement of the chair assembly between the lower position and the upper position.

* * * * *